United States Patent [19]

Makino et al.

[11] 4,439,868

[45] Mar. 27, 1984

[54] MEDICAL X-RAY RADIATION POWER SUPPLY APPARATUS

[75] Inventors: Takao Makino, Hikone; Toshiaki Ikeda, Yahata, both of Japan

[73] Assignee: Kabushiki Kaisha Morita Seisakusho, Kyoto, Japan

[21] Appl. No.: 476,277

[22] Filed: Mar. 17, 1983

[30] Foreign Application Priority Data

Mar. 18, 1982 [JP] Japan ..... 57-38966[U]

[51] Int. Cl.[3] ..... H05G 1/34

[52] U.S. Cl. ..... 378/112; 315/106; 315/307

[58] Field of Search ..... 378/112, 110, 109, 111; 315/106, 107, 307

[56] References Cited

U.S. PATENT DOCUMENTS 3,974,387 8/1976 Brönner et al. ..... 378/112

4,221,968 9/1980 Franke ..... 378/112

*Primary Examiner*—Alfred E. Smith

*Assistant Examiner*—T. N. Grigsby

*Attorney, Agent, or Firm*—Koda and Androlia

[57] ABSTRACT

The present invention relates to a medical X-ray radiation power supply apparatus wherein a DC-operated switching circuit is connected at the primary side of a high voltage transformer, and a comparator circuit compares the voltage predetermined by a tube voltage setting circuit with an actual tube voltage detected by a tube voltage detector circuit, then the gain of a comparison voltage is raised so that the actual tube voltage can quickly reach the predetermined tube voltage value, thereby tube voltage errors, which are caused by short photographing time in a medical or breast X-ray photographing apparatus, are eliminated.

4 Claims, 2 Drawing Figures

MEDICAL X-RAY RADIATION POWER SUPPLY APPARATUS

BACKGROUND OF THE INVENTION

1. Field of the Invention

This invention relates to a medical X-ray radiation power supply apparatus quickly raising a tube voltage to a predetermined value by using a DC-operated switching power supply in a dental or breast X-ray photographing apparatus.

2. Prior Act

The AC power supplies have been previously used in a dental or breast apparatus. However, the apparatus cannot deliver stable X-ray energy. Recently, an apparatus and technology using DC power supply to control an X-ray radiation has been disclosed. For example, the Patent Application No. 53-17066 (Japanese Provisional Publication No. 54-112190) discloses a technology of a DC-operated switching power supply. This method relates to a panoramic X-ray photograph apparatus for entire jaws, and it takes more than several hundred milliseconds until X-rays reach the predetermined value after an X-ray radiation start switch is turned on. This time period causes no problem since the photographing is done within approximately 10 to 20 seconds.

However, in a case of dental X-ray photograph apparatus, except a panoramic X-ray photograph apparatus for entire jaws, the shortest photographing time is approximately 0.1 to 0.2 seconds. When the tube voltage rising time for an X-ray radiation is long, compared with the short photographing time, the obtained results have considerable errors.

Regarding the medical X-ray photograph apparatus technology identical to the present invention, an X-ray power supply circuit using DC-operated phase control is also disclosed by the Utility Model Application No. 55-16078 (Japanese Provisional Publication No. 56-118607). This circuit has the disadvantages that an overshoot occurs and the linearity between the rise of tube voltage and radiation time is not satisfactory.

SUMMARY OF THE INVENTION

It is, therefore, a principal object of the present invention to provide a power suply apparatus including a DC-operated switching circuit, and a comparator circuit for comparing the voltage predetermined by a tube voltage setting circuit with an actual tube voltage detected by a tube voltage dectector circuit. The gain of the comparison circuit is raised so that the actual tube voltage can quickly reach at the predetermined tube voltage value. These objectives will become more apparent by a preferred embodiment of the present invention and the drawings.

and

Figure 1:
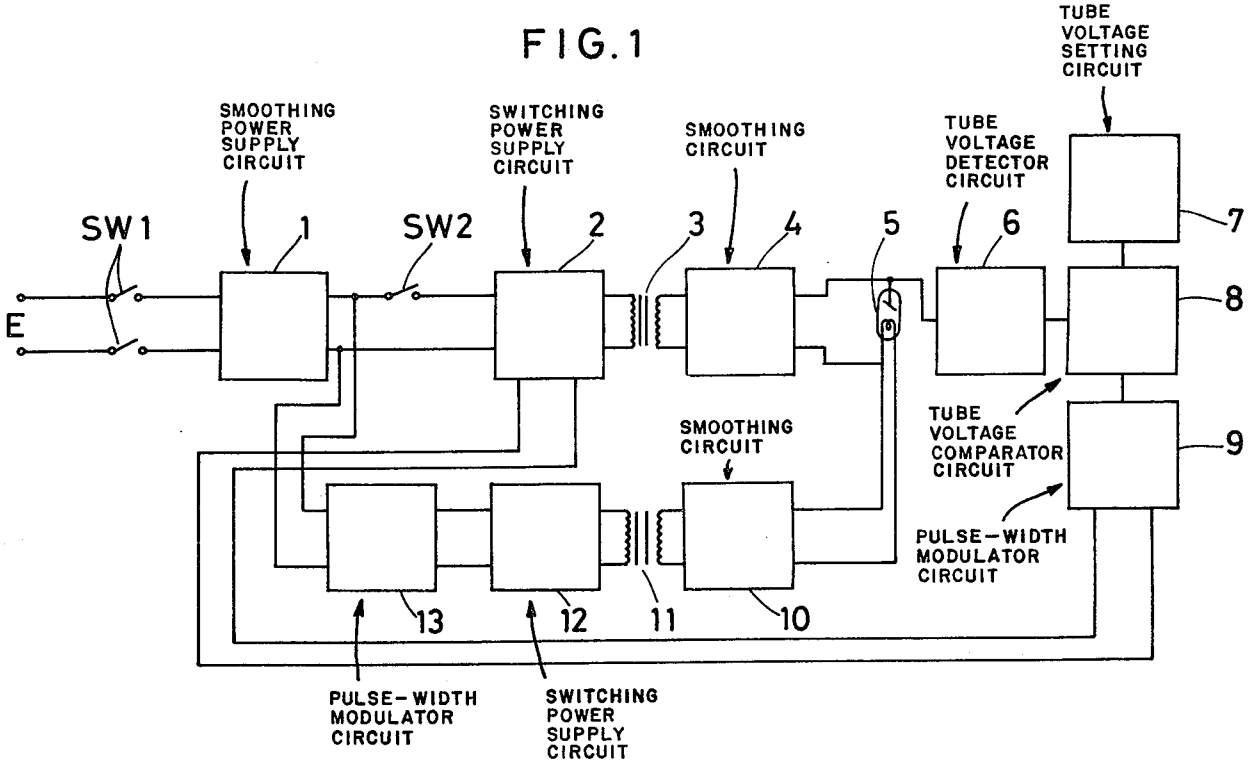
FIG. 1 is a block diagram of an embodiment of the present invention.
Figure 2:
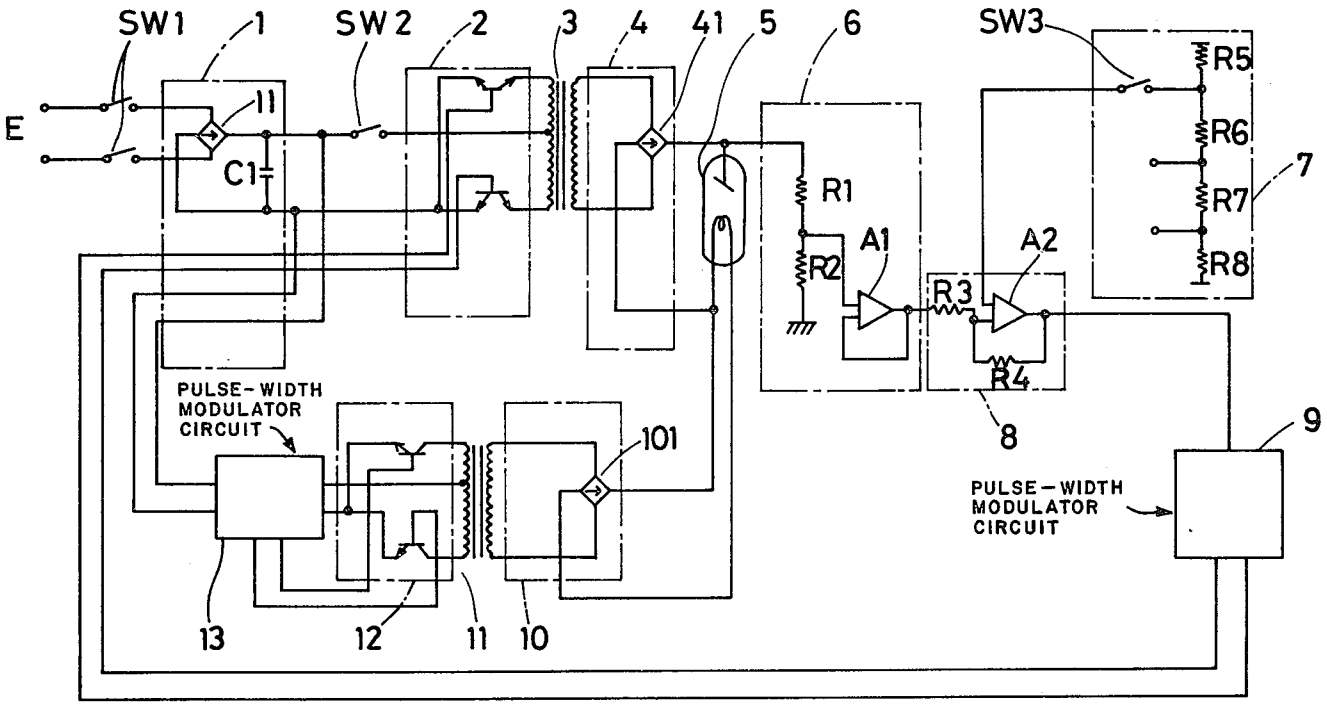

FIG. 2 is a circuit diagram specifically showing the embodiment of FIG. 1.

DETAILED DESCRIPTION OF THE INVENTION

Referring to FIG. 1, numeral 1, numeral 1 is a smoothing power supply circuit which is connected to a commercially available power E through a main switch SW1. The circuit 1 rectifies the commercially available power E. The output of the smoothing power supply circuit 1 is supplied to a switching power supply circuit 2 connected to the primary side of a high voltage transformer 3. The output of the smoothing power supply circuit 1 is also supplied to a switching power supply circuit 12 connected to the primary side of a filament transformer 11 through a pulse-width modulator circuit 13.

An X-ray tube 5 is connected to the secondary side of the high voltage transformer 3 through a smoothing circuit 4. A tube voltage detector circuit 6 is connected to the anode side of the X-ray tube 5.

A comparator circuit 8 which compares the predetermined tube voltage of a tube voltage setting circuit 7 with a detected tube voltage of the circuit 6 is further connected to the circuit 6. The output of the comparator circuit 8 is supplied to the switching power supply circuit 2 through a pulse-width modulator circuit 9. The secondary side of the filament transformer 11 is connected to the cathode of the X-ray tube 5 through a smoothing circuit 10.

In the above circuitry, the smoothing power supply circuit 1, X-ray radiation switch SW2, switching power supply circuit 2, high voltage transformer 3, smoothing circuit 4, tube voltage detector circuit 6, tube voltage setting circuit 7, tube voltage comparator circuit 8 and pulse width modulator circuit 9 a high voltage generator network for the X-ray tube 5. The pulse-width modulator circuit 13, switching power supply circuit 12, filament transformer 11 and smoothing circuit 10 a filament power supply network for the X-ray tube 5.

In this circuit arrangement of the present invention, the commercially available power E at the primary side of the high voltage transformer 3 is rectified by the smoothing power supply circuit 1, and the switching power supply circuit 2 controls the primary voltage of the high voltage transformer 3 which receives a signal from the pulse-width modulator circuit 9 at the secondary side of the high voltage transformer 3. The secondary side voltage of the high voltage transformer 3 is supplied to the X-ray tube 5 through the smoothing circuit 4. The tube voltage detector circuit 6 connected to the X-ray tube 5 includes a buffer amplifier A1 which is subjected to a voltage division by the resistors R1 and R2 as shown in FIG. 2. The comparator circuit 8 compares the predetermined tube voltage which is selected by a tube voltage setting switch SW3 (a rotary switch) in the tube voltage setting circuit 7 with the actual tube voltage which is detected by the tube voltage detector circuit 6. In other words, the actual tube voltage is amplified several tens of times larger depending on the gain (R4/R3) of an amplifier A2 and is quickly raised to the tube voltage value predetermined by the tube voltage setting circuit 7. The output of the comparator circuit 8 is pulse-width modulated by the pulse-width modulator circuit 9 and is transmitted to the switching power supply circuit 2.

At the filament transformer side, the voltage rectified by the smoothing power supply circuit 1 is supplied to the primary side of the filament transformer 11 through the pulse-width modulator circuit 13 and the switching power supply circuit 12. At the secondary side of the filament transformer 11, the secondary voltage is supplied to the cathode of the X-ray tube 5 through a smoothing circuit 10.

As described above, the present invention is constructed such that the commercially available AC Power is once converted into DC power, and the DC power is subjected to a switching control. Therefore, the invention is suited for the power supply means of an X-ray photograph apparatus which needs only a short X-ray radiation time such as a dental or breast X-ray photographing apparatus. Furthermore, since the tube voltage rises quickly, any harmful soft X-rays are not generated, and stable control without overshoot becomes possible. Consequently, the apparatus of this invention is capable of maintaining a stable tube voltage to take accurate photographs even when the photographing time is as short as several tens of milliseconds.

We claim:

1. A medical X-ray radiation power supply apparatus comprising:

a high voltage generation network comprising:

a smoothing power supply circuit for rectifying commercially available power;

a first switching power supply circuit coupled to an output of said smoothing power supply circuit, said switching power supply circuit further having a switching input;

a high voltage transformer with primary and secondary windings, said primary winding be coupled to an output of said first switching power supply circuit;

a first smoothing circuit coupled to said secondary winding and having its output coupled to an X-ray tube;

an X-ray tube voltage detector coupled to said secondary windings for detecting the magnitude of the X-ray tube voltage;

an X-ray tube setting circuit for setting an X-ray tube reference voltage;

a comparator circuit for comparing said detected X-ray tube voltage with said reference voltage and for generating an output indicative of the comparison; and a first pulse-width modulator circuit which generates a pulse-width modulated pulse in response to the output of said comparator circuit, said pulse-width modulated pulse being supplied to said switching input of said first switch power supply circuit to control said tube voltage of said X-ray tube;

a filament power supply network comprising;

a second pulse-width modulator circuit coupled to said output of said smoothing power supply circuit;

a second switching power supply circuit coupled to an output of said second pulse-width modulator circuit;

a filament transformer having a primary and secondary windings, said primary winding being coupled to said second switching power supply circuit; and a second smoothing circuit coupled to said secondary winding of said filament transformer and having its output coupled to a filament of said X-ray tube.

2. A medical X-ray radiation power supply apparatus according to claim 1 wherein said comparator circuit comprises amplifier means which amplifys the detected tube voltage whereby the tube voltage may be quickly changed.

3. An apparatus according to claim 2 wherein said smoothing power supply circuit and said first and second smoothing circuits each comprise a diode bridge circuit.

4. An apparatus according to claim 3 wherein said X-ray tube setting circuit comprises a plurality of selectable resistors.

* * * * *